US005330106A

United States Patent [19]

Braun, Jr.

[11] Patent Number: 5,330,106

[45] Date of Patent: Jul. 19, 1994

[54] HOSE SWIVEL SYSTEM FOR DISPENSERS

[75] Inventor: Arnold W. Braun, Jr., Trenton, Mich.

[73] Assignee: Graco Inc., Minneapolis, Minn.

[21] Appl. No.: 54,147

[22] Filed: Apr. 30, 1993

[51] Int. Cl.[5] ..... B05B 7/02; B05B 9/03; B05B 15/08

[52] U.S. Cl. ..... 239/526; 239/587.2; 239/587.6; 222/145; 222/533; 285/136

[58] Field of Search ..... 222/526, 533, 74, 145; 239/587.1, 587.5, 587.6, 587.2, 525, 526, 530; 285/136, 190, 273

[56] References Cited

U.S. PATENT DOCUMENTS

| | | | |
|---|---|---|---|
| 535,669 | 3/1895 | Burt | 239/587.5 |
| 2,011,446 | 8/1935 | Judell | 239/587.6 |
| 2,943,868 | 7/1960 | Hanbeck | 285/190 |
| 3,826,431 | 7/1974 | Telge | 239/587.5 |
| 3,949,778 | 4/1976 | Woodford et al. | 285/136 |
| 3,981,329 | 9/1976 | Wohlwend | 285/136 |
| 4,787,655 | 11/1988 | Gross et al. | 285/273 |
| 5,110,049 | 5/1992 | Harris et al. | 239/526 |
| 5,110,159 | 5/1992 | Herold et al. | 285/136 |

FOREIGN PATENT DOCUMENTS

| | | | |
|---|---|---|---|
| 3243378 | 7/1983 | Fed. Rep. of Germany | 239/587.6 |

*Primary Examiner*—Andres Kashnikow
*Assistant Examiner*—Christopher G. Trainor
*Attorney, Agent, or Firm*—Beaman & Beaman

[57] ABSTRACT

A dispenser system wherein the dispensed material is supplied to a valved nozzle through flexible hoses. The valved nozzle is located in a dispenser gun usually hand held and a swivel distributor interconnecting the hoses to the dispenser gun structure achieves superior ergonomic characteristics.

12 Claims, 2 Drawing Sheets

HOSE SWIVEL SYSTEM FOR DISPENSERS

BACKGROUND OF THE INVENTION

1. Field of the Invention

The invention pertains to a dispenser system utilizing a dispensing nozzle supplied through flexible hose wherein movement of the dispenser relative to the hose is facilitated by a swivel connection.

2. Description of the Related Art

Hand held dispensers commonly employ a nozzle or gun wherein the material being supplied is conveyed to the dispenser via a flexible hose or hoses. Usually, the hose is rigidly connected to the dispenser and movement of the dispenser is permitted due to the flexibility of the supply hose or hoses. Accordingly, it will be appreciated that the degree of effort required to translate, position and direct the dispenser is, to a large part, determined by the weight and flexibility of the supply hose.

In the manufacture of automobile bodies, for instance, hardenable foaming materials are often dispensed into vehicle body parts and sections for soundproofing, rigidity, moisture resistant or sound deadening purposes. In such instances, the operator will be located within the vehicle body, or must reach into the vehicle body through a window or door opening, to properly locate the dispenser for placing the dispensed material as desired. Because of the confinement of the vehicle and the intricacies and configuration of the parts in which the foaming material is to be deposited, extensive manual movement of the dispenser gun and hose is required. Normally, the supplying hoses are rigidly attached to the dispenser gun and the flexibility of gun movement is permitted due to the flexible nature of the supply hoses.

However, as dispensers distributing foaming materials utilize two hoses, one hose supplying a resin compound while the other hose supplying a reactant material, and as the supply hoses are normally sheathed within an electrically heated Jacket, the degree of flexibility permitted by the hose is limited, and the hose assembly flexibility is relatively "stiff". Accordingly, it is necessary for the operator handling the dispenser gun to expend considerable effort in maneuvering the dispenser gun and attached hoses within confined quarters, and the operators commonly experience fatigue, muscle strain, carpal tunnel syndrome, and other physical maladies.

Further, difficulty in positioning the dispenser exactly as desired may result in improper or incomplete application of the foaming material, and difficulty in properly positioning the dispenser, adversely affects the quality of the work product.

OBJECTS OF THE INVENTION

It is an object of the invention to provide a dispenser system utilizing a dispenser supplied by flexible hoses wherein the hoses are attached to the dispenser through a distributor having swiveled connections wherein the swiveling action permitted reduces the effort required to position the dispenser gun and provides a flexibility heretofore not achieved with this type of system.

An additional object of the invention is to provide a dispenser system utilizing a hand held dispenser supplied by a pair of supply hoses wherein the hoses are connected to the dispenser through a swiveling distributor significantly improving the ergonomic characteristics of the system.

Yet another object of the invention is to provide a dispenser system capable of dispensing foamable materials utilizing a pair of flexible supply hoses connected to a dispenser wherein the supply hoses supply the dispenser through a swiveling distributor which accommodates both hoses within a concise dimension, reduces the weight of hose supported by the operator and reduces hose kinking.

Yet another object of the invention is to provide a dispenser system employing a dispenser supplied by a pair of supply hoses wherein the hoses are connected through a swiveling distributor easily connected to a dispenser gun, and the distributor is capable of pivotal movement in three dimensions about perpendicularly related axes to achieve universal flexibility of movement between the supply hoses and dispenser.

SUMMARY OF THE INVENTION

A dispenser system utilizing the concepts of the invention will include a pumping unit for supplying the materials to be dispensed which will provide materials which react together to form the desired hardenable foam, and in many instances the pumping unit will supply an isocyanide material through one supply hose and a resin compound through the other supply hose. Normally, the supply hoses are located within an electrically heated jacket in order to maintain a low material viscosity and the material pressure is regulated prior to being supplied to a dispenser gun. The dispenser gun utilizes a valved nozzle and the supplied materials are intermixed at the nozzle at the time of dispensing wherein the reaction between the dispensed materials does not begin until dispensing occurs.

The flexible hoses conveying the materials to be mixed and dispensed are connected to a distributor rigidly attached to the dispenser gun. The distributor includes spaced coaxial end portions and a swivel connector is rotatably mounted upon each end portion. The swivel connectors, hereinafter referred to as swivels, include passages connected to the supply hose ends, and the swivels also communicate with separate distributor bores which, in turn, communicate with separate conduits attached to the dispenser nozzle. As both hoses are connected to the distributor by the use of swivels rotatable about a common axis excellent flexibility between the dispenser and hose is achieved, and pivoting of the dispenser relative to the hose requires little effort. Further, the swivel connection between the hose and gun reduces the hose weight imposed upon the dispenser gun and the degree of swiveling achievable is in excess of 180°.

The distributor is preferably attached to the inner end of the dispenser gun remote from the valved nozzle, and the dispenser casing is preferably provided with distributor connection means permitting the distributor and casing to be firmly interconnected. A cover removably mounted upon the casing overlaps the distributor and casing interconnection maintaining the relationship of the components while minimizing fastening structure.

In an embodiment of the invention the distributor is mounted to the dispenser gun casing by a hinged Joint having a pivotal axis perpendicularly disposed to the distributor swivel axis wherein the distributor may, itself, swivel relative to the dispenser gun. In this embodiment, the distributor is connected to the valved nozzle by flexible hose conduits, and the three dimensional adjustment achieved by this embodiment even further increases the flexibility between the hose assembly and the dispenser gun and permits even greater ergonomic advantages than achieved with a dispenser having swivels rotating about a single axis.

For ergonomic reasons, it is desirable that a hand held dispenser system be of as light a weight as possible, and the hose and dispenser system utilizing the concepts of the invention can be produced at a weight lighter than that previously achievable, and the use of the supply hose distributor swivels further reduces the weight required to be supported by the operator.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figures 1, 2, 3, 4, 5, 6:
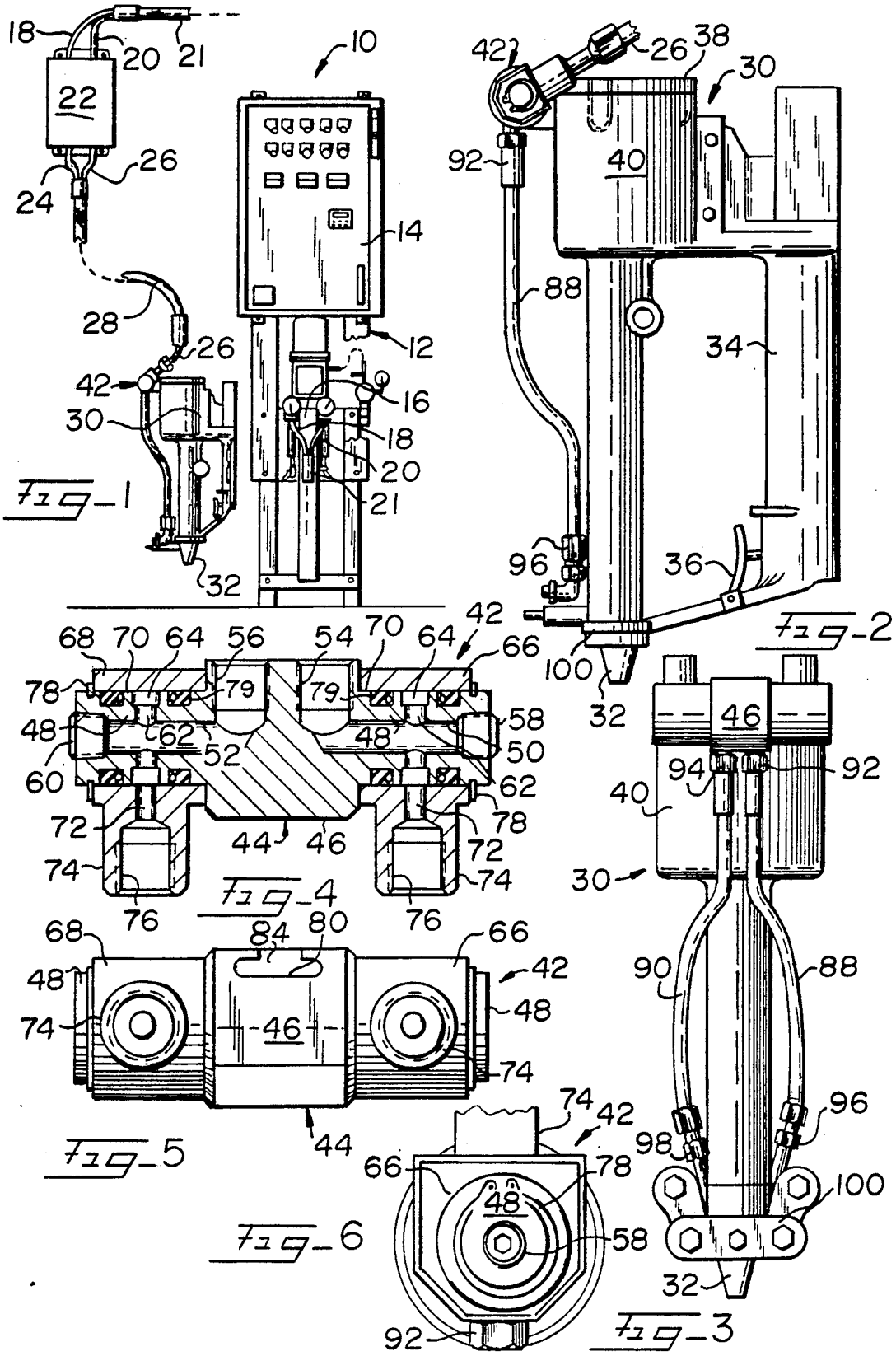
FIG. 1 is a partially schematic elevational view of a distributor system illustrating the basic components of the system of the invention.
FIG. 2 is an enlarged side elevational view of a dispenser gun utilizing the swiveling distributor of the invention.
FIG. 3 is a front elevational view of the dispenser gun of FIG. 2 as taken from the left thereof.
FIG. 4 is a diametrical sectional view of the distributor, per se.
FIG. 5 is an elevational view of the distributor, per se, as taken from the bottom of FIG. 4.
FIG. 6 is an end elevational view of the distributor, per se.

With reference to FIG. 1, the overall dispensing system is illustrated at 10 and includes a pump unit 12 having electrical controls 14 wherein the output of the pumping system is indicated at 16 and includes flexible hose 18 and 20 which is enclosed within an electrically heated insulating Jacket 21. As the illustrated dispensing system is for the purpose of dispensing reactive materials for producing a hardenable foam, the hose 18 is provided by the pumping unit 12 with an isocyanide material, while the hose 20 is supplied with a resin compound.

The hoses 18 and 20 communicate with a pressure regulator 22 whose output is connected to flexible hoses 24 and 26 located within a flexible electrically heated insulated jacket 28. The ends of the hoses 24 and 26 are provided with conventional compression type connections utilizing a ferrule and compression nut.

The hoses 24 and 26 provide the foam generating materials to a dispenser gun 30 which includes a valved nozzle 32. The dispenser 30, as illustrated, is of the manually held type and includes a handle 34 for gripping by the operator and a trigger 36 controls the opening and closing of the nozzle 32 to regulate the flow of mixed foamable material therefrom. A cover 38 is used to enclose the inner end of the dispenser gun casing 40, and cap screws, not shown, are employed to removably attach the cover 38 to the casing 40. Internally, the casing 40 includes the controls for the valve's nozzle 32 and other sensing and regulating apparatus constituting no part of the present invention.

The flexible hoses 24 and 26 are attached to the dispenser gun 30 through a distributor 42 which is attached, as later described, to the inner end of the dispenser gun 30. The distributor 42 includes a housing 44 having end regions 48 extending in opposite directions from the housing central region 46. The end regions 48 are generally cylindrical in configuration and coaxial.

As viewed in FIG. 4, the right end region 48 includes a coaxial bore 50, while the left end region includes a coaxial bore 52. Bore 50 communicates with threaded port 54 defined in the distributor housing central region 46, while the threaded port 56 communicates with the end region bore 52. The threaded plug 58 encloses the end of bore 50, while the threaded plug 60 encloses the end of bore 52. Radial holes 62 are defined in the distributor end regions and cooperate with annular channels 64 defined in the outer surface of the end regions and the adjacent end region bores 50 and 52. In this manner, the channels 64 will be in communication with either port 54 or 56.

The swivel connectors, or swivels 66 and 68, are rotatably mounted upon the distributor end regions 48. Each of the swivels 66 and 68 includes a bore 70 receiving a distributor end region and each of the swivels includes a radial passage 72 for communicating with the associated end region channel 64 as will be appreciated from FIG. 4. Radial bosses or projections 74 extend from each swivel 66 and 68 and the bosses each include a threaded port 76. The swivels 66 and 68 are maintained upon their respective distributor end region by retainer clips 78 received within an associated groove, as will be appreciated from FIG. 4.

The hose conduit 24 will be connected by a conventional fitting, such as a ferrule end compression nut, to the port 76 of one of the swivels, 66 for instance, and the threaded fitting at the end of the hose 26 will be connected to the threaded port 76 of the other swivel 68. Resilient seals 79 are located upon each of the distributor end regions 48 on opposite sides of the associated channel 64, and preferably, the seals 79 are of the lip seal type capable of providing effective sealing between the distributor end regions and the swivels 66 and 68 at all rotative positions of the swivels upon the distributor housing 44.

Figure 7:
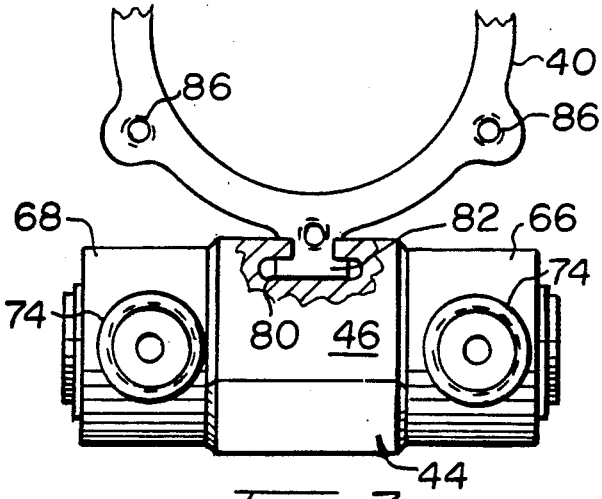
FIG. 7 is a plan view of the distributor, partially sectioned, as mounted upon a dispenser gun casing, the casing cover being removed.
Figure 8:
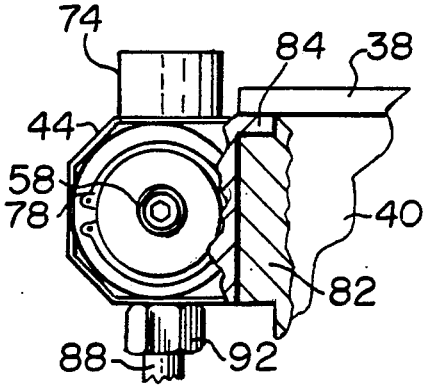
FIG. 8 is a side elevational view as taken from the right of FIG. 7, the interconnection between the distributor and casing being broken away for purpose of illustration.

A T-recess 80 is defined in one side of the distributor housing central region 46, FIG. 5, and the T-recess includes an end 84, FIG. 8, which closes one end of the recess. A complementary T-projection 82 is defined upon the dispenser gun casing 40, FIG. 7, and the T-projection 82 is received within the distributor recess 80 by merely slipping the distributor housing over the projection 82 until the end 84 engages the top of the T-projection 82. Threaded holes 86 formed in the dispenser casing 40 receive cap screws, not shown, whereby the casing cover 38 may be attached to the top of the casing and the cover 38 will overlap the distributor end 84 maintaining the distributor upon the casing T-projection 82 by the assembly of the cover 38 to the casing 40.

The distributor housing 44 is connected to the valved nozzle 32 by conduits 88 and 90, and in the embodiment shown in FIGS. 1–8 the conduits 88 and 90 may either be hard tubing, or flexible hose. The conduit 88 includes a threaded fitting 92 at one end which threads into the port 54 within the distributor central region 46, while the conduit 90 includes fitting 94 which threads into the port 56. At the other end of the conduit 88 the fitting 96 threads into a nozzle inlet port on the nozzle head 100, while the fitting 98 of the conduit 90 is threadedly connected to the other nozzle inlet of the nozzle head 100. The materials being supplied to the dispenser gun 30 are intermixed at the nozzle head 100 during flow through the nozzle 32 as controlled by the trigger 36, and the intermixing of the materials within the conduits 88 and 90 at the nozzle head 100 as material flows through the nozzle initiates the chemical reaction to produce the desired foaming, as well known.

The swivels 66 and 68 are capable of approximately a 190° rotation on their respective distributor end regions, and this high degree of swiveling permits considerable flexibility and movement of the distributor gun 30 relative to the supply hoses without requiring flexing of the hoses or the associated insulating jacket 28. Accordingly, the aforedescribed swivel interconnection between the hose system and the dispenser gun significantly improves the ergonomic characteristics of a system of this type as previously constructed, and the weight of the hose imposed upon the dispenser gun is reduced, and hose kinking is minimized. Also, due to the unique construction of the distributor housing 44 having the associated hose swivels located thereon permits the entire "plumbing" format to be concise, and the short interconnection between the distributor 42 and the nozzle head 100, particularly when using hard tube conduits, facilitates handling of the dispenser gun, and minimizes the likelihood of damage to the conduit system. Many of the metallic components of the distributor system, including the casing of the dispenser gun, may be formed of a light aluminum alloy having a hard coat to improve wear, and likewise, the components of the distributor 42 may be formed of aluminum.

Figure 9:
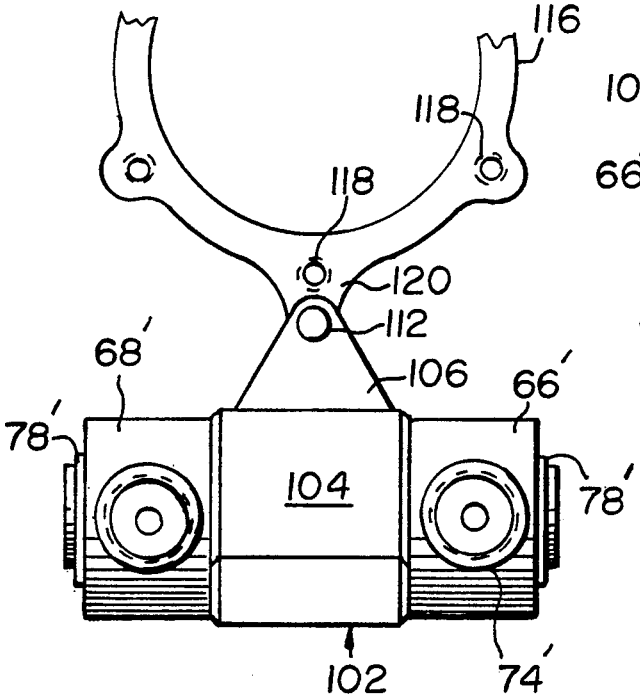
FIG. 9 is a top plan view of an embodiment of the invention wherein the distributor is attached to the casing by a hinged Joint.
Figure 10:
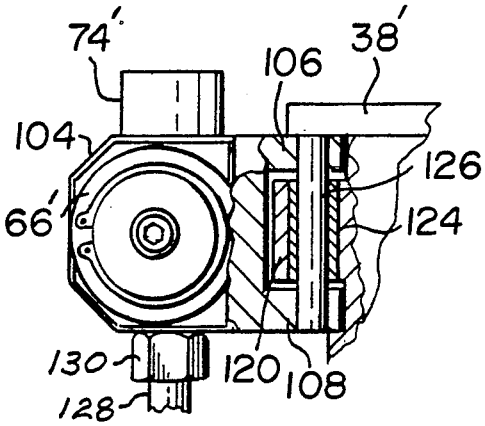
FIG. 10 is a side elevational view of the embodiment of FIG. 9 illustrated the hinged joint, a portion of the drawing being broken away and shown in section.

A variation of the invention is illustrated in FIGS. 9 and 10 wherein components similar to those previously described are indicated by primed reference numerals. In these figures the distributor is generally indicated at 102 and includes a central region 104. A pair of hinged ears 106 and 108, FIG. 10, are homogeneously defined on the distributor central region 104 and each includes aligned holes 112. The dispenser gun casing 116 includes threaded holes 118 for permitting the casing cover 38' to be mounted upon the casing, and a hinge projection member 120 homogeneously extends from the casing 116, FIG. 10. A brass sleeve 124 is mounted within the hinge member 120, and a pivot pin 126 extends through the holes 112 and the sleeve 124 to pivotally mount the distributor 102 upon the casing 116 for limited pivotal movement about the pivot pin 126. It will be appreciated that the axis of the pivot pin 126 is perpendicularly related to the axis of the end regions of the distributor 102. The conduit 128 communicates with the port, not shown, formed in the central region 104 by the threaded fitting 130, and the nozzle head, not shown, of the dispenser gun, and in view of the pivotal mounting of the distributor 102 upon the casing 116 it is necessary that the conduit 128 constitute a flexible hose to permit such limited pivoting, and likewise, the other conduit, not shown, connecting the distributor 102 to the associated distributor gun nozzle head will also comprise a flexible hose.

The embodiment of FIGS. 9 and 10 permits a three dimensional movement of the ends of the supply hose associated with the swivels 66' and 68', and for little extra cost the embodiment of FIGS. 9 and 10 provides additional flexibility and improved ergonomic advantages over the embodiments of FIGS. 1–8.

It is appreciated that various modifications to the disclosed embodiments may be apparent to those skilled in the art without departing from the spirit and scope of the invention.

I claim:

1. In a dispenser system wherein a material to be dispensed is supplied by a pair of flexible supply hoses to a dispenser having a valved nozzle, the improvement comprising, a distributor having an axis mounted upon the dispenser, first and second bores defined in said distributor each in communication with the nozzle, first and second swivels rotatably mounted upon said distributor for rotation thereto about said distributor axis, a third bore defined in said first swivel in communication with said first bore during swiveling of said first swivel, a fourth bore defined in said second swivel in communication with said second bore during swiveling of said second swivel, and hose connection ports defined on each of said swivels in communication with the associated swivel bore whereby each of said swivels may be attached to a respective one of supply hoses.

2. In a dispenser system as in claim 1, said swivels coaxially rotating about said distributor axis.

3. In a dispenser system as in claim 2, said distributor being of an elongated configuration having a central region and first and second end regions, distributor mounting means defined upon said central region, said first and second swivels being rotatably mounted upon said first and second end regions, respectively.

4. In a dispenser system as in claim 3, first and second outlet ports defined on said distributor central region, said first bore and said first outlet port and said second bore and said second outlet port, respectively, being in communication, separate conduits interconnecting said ports to the nozzle.

5. In a dispenser system as in claim 3, a retainer ring mounted upon each of said distributor end regions, each of said retaining rings maintaining a said swivel upon the associated end region.

6. In a dispenser system as in claim 3, the dispenser including a removable cover, said dispenser mounting means including a headed projection defined upon the dispenser adjacent said cover, a recess defined in said distributor central region complementary in configuration to said projection adapted to receive said projection, said cover overlaying said central region and retaining the distributor recess upon the dispenser projection.

7. In a dispenser system as in claim 3, said dispenser mounting means comprising hinge members defined upon the dispenser and said distributor central region and a pivot pin mounted in said hinge members having an axis substantially perpendicular to said distributor axis whereby said swivels are capable of pivoted movement in three dimensions relative to the dispenser.

8. In a dispenser system as in claim 7, said hinge members comprising spaced extensions having a pivot pin receiving bore defined therein, said extensions of the dispenser and distributor central region intermeshing.

9. A dispenser supplied by a pair of flexible hoses characterized by its ergonomic characteristics comprising, in combination, a dispenser housing adapted to be hand held having an inner end and an outer end, a valved nozzle defined on said housing outer end, a valve control mounted on said housing, a distributor having an axis mounted upon the dispenser, first and second bores defined in said distributor each in communication with the nozzle, first and second swivels rotatably mounted upon said distributor for rotation thereto about said distributor axis, a third bore defined in said first swivel in communication with said first bore during swiveling of said first swivel, a fourth bore defined in said second swivel in communication with said second bore during swiveling of said second swivel, and hose connection ports defined on each of said swivels in communication with the associated swivel bore whereby each of said swivels may be attached to one of said flexible supply hoses.

10. In a dispenser as in claim 9, said distributor being of an elongated configuration having a central region and first and second end regions, distributor mounting means defined on said central region, dispenser mounting means defined on said dispenser housing adjacent said inner end, said mounting means being interconnected, said first and second swivels being rotatably mounted upon said first and second end regions, respectfully.

11. In a dispenser as in claim 10, first and second outlet ports defined on said distributor central region, said first bore and first outlet port and said second bore and said second outlet port, respectively, being in communication, separate conduits interconnecting said ports to said valved nozzle.

12. In a dispenser as in claim 11, said mounting means comprising interengaging hinge members having a pivot axis substantially perpendicular to said distributor axis whereby said swivels are capable of pivotal movement in three dimensions relative to said dispenser housing, said separate conduits interconnecting said ports to said valved nozzle comprising flexible hose.

* * * * *